US009846379B2

(12) United States Patent
Onishi et al.

(10) Patent No.: US 9,846,379 B2
(45) Date of Patent: Dec. 19, 2017

(54) PROCESS FOR PRODUCING A TONER

(71) Applicant: Konica Minolta, Inc., Tokyo (JP)

(72) Inventors: Junya Onishi, Tokyo (JP); Shiro Hirano, Tokyo (JP); Noboru Ueda, Tokyo (JP); Kouji Sugama, Tokyo (JP); Aya Shirai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/370,134

(22) Filed: Dec. 6, 2016

(65) Prior Publication Data

US 2017/0168407 A1 Jun. 15, 2017

(30) Foreign Application Priority Data

Dec. 14, 2015 (JP) ..... 2015-243461

(51) Int. Cl.
*G03G 9/08* (2006.01)
*G03G 9/087* (2006.01)
*G03G 9/093* (2006.01)

(52) U.S. Cl.
CPC ..... *G03G 9/0804* (2013.01); *G03G 9/0819* (2013.01); *G03G 9/08711* (2013.01); *G03G 9/08755* (2013.01); *G03G 9/09328* (2013.01); *G03G 9/09364* (2013.01); *G03G 9/09392* (2013.01)

(58) Field of Classification Search
CPC ..... G03G 9/0804
See application file for complete search history.

(56) References Cited

U.S. PATENT DOCUMENTS

| | | | | |
|---|---|---|---|---|
| 7,494,757 | B2 | 2/2009 | Sacripante et al. | |
| 2006/0240353 | A1* | 10/2006 | Matsumura | G03G 9/0806 430/109.4 |
| 2015/0247000 | A1* | 9/2015 | Moriyama | C08G 63/16 524/604 |

FOREIGN PATENT DOCUMENTS

| | | | |
|---|---|---|---|
| JP | 2001222138 | A | 8/2001 |
| JP | 2009063992 | A | 3/2009 |
| JP | 2012042508 | A | 3/2012 |
| JP | 2012098697 | A | 5/2012 |
| JP | 2014211632 | A | 11/2014 |

* cited by examiner

*Primary Examiner* — Hoa V Le
(74) *Attorney, Agent, or Firm* — Lucas & Mercanti, LLP

(57) ABSTRACT

The production process of the present invention includes: a first step of heating a dispersion containing an aqueous medium and a binder resin containing a crystalline resin to a temperature higher than or equal to the melting point of the crystalline resin in a step of aggregating and fusing a fine particle of the binder resin containing the crystalline resin to produce a toner base particle; a second step of cooling the dispersion having been heated in the first step and having a temperature higher than the recrystallization temperature Rc of the crystalline resin to a temperature lower than Rc at a temperature-lowering rate of 1° C./min or higher; and a third step of maintaining the dispersion having been cooled in the second step at a temperature higher than or equal to Rc−25° C. and lower than or equal to Rc−5° C. for 30 minutes or longer.

5 Claims, 1 Drawing Sheet

PROCESS FOR PRODUCING A TONER

CROSS REFERENCE TO RELATED APPLICATIONS

This application is entitled to and claims the benefit of Japanese Patent Application No. 2015-243461, filed on Dec. 14, 2015, the disclosure of which including the specification, drawings and abstract is incorporated herein by reference in its entirety.

BACKGROUND OF THE INVENTION

1. Field of the Invention

The present invention relates to a process for producing a toner for development of electrostatic images.

2. Description of Related Art

To increase printing speed and achieve further saving of energy for reduction of environmental loads in electrophotographic image forming apparatuses, a toner for development of electrostatic images (hereinafter, simply referred to as "toner") which is capable of heat fixing at lower temperatures has been recently required. Such a toner needs lowering of the melting temperature and melt viscosity of a binder resin, and a toner having low-temperature fixability enhanced by adding a crystalline resin such as a crystalline polyester resin is suggested (e.g., see Japanese Patent Application Laid-Open No. 2001-222138). When a toner containing a crystalline resin is heated to a temperature higher than or equal to the melting point of the crystalline resin in production of the toner, however, the crystalline resin becomes compatible with an amorphous resin even in production, which inconveniently deteriorates the high-temperature storability.

Annealing (hereinafter, also referred to as heat treatment) is known as means for enhancing the high-temperature storability of a toner having such a configuration. For example, it is reported that heat treatment at a temperature higher than or equal to the glass transition temperature of an amorphous resin and lower than or equal to the melting point of a crystalline resin−10° C. for a long duration allows the crystalline resin which is compatible with the amorphous resin to recrystallize to enhance the high-temperature storability (e.g., see Japanese Patent Application Laid-Open No. 2009-063992).

In addition, there is known a method of controlling the heating/retention temperature for an aqueous dispersion of a crystalline resin of a block polymer (e.g., see Japanese Patent Application Laid-Open No. 2014-211632). According to the document, this method enables control of the crystalline resin domain even in recrystallization of the crystalline resin, and thus the crystalline resin domain can be finely dispersed to prevent deterioration of fixability.

Further, it is reported that heating and retention of a toner composition containing a binder resin containing a crystalline polyester under predetermined conditions allows the toner to keep the low-temperature fixability and high-temperature storability for a long period (e.g., see Japanese Patent Application Laid-Open No. 2012-42508). Furthermore, a method is known in which a differential scanning colorimetry (DSC) curve is obtained in measurement for a crystalline polyester resin by using a differential scanning colorimeter and heat treatment is performed at the onset temperature of an endothermic peak in the DSC curve ±5° C. (e.g., see Japanese Patent Application Laid-Open No. 2012-98697). Moreover, there is known heat treatment of a toner particle containing a crystalline resin and an amorphous resin at a temperature which is higher than or equal to the glass transition temperature of the crystalline resin and is the recrystallization temperature ±10° C. (e.g., see U.S. Pat. No. 7,494,757).

In dry heat treatment, however, the elevation of the glass transition temperature, the increase of the domain diameter of a crystalline resin in a toner, etc., are caused due to the change of the moisture adsorption state of a toner, which complicates development of low-temperature fixing performance at a level required in recent years. In addition, a crystalline resin exposed in the surface of a toner lowers the surface resistance of the toner and deteriorates the charging characteristics of the toner, which may inconveniently cause troubles such as toner splashing. In heat treatment in an aqueous medium, a crystalline resin may have been exposed in the surface of a toner.

Thus, conventional production processes for a toner leave room for improvement from the viewpoint of further enhancement of the low-temperature fixability of a toner and reduction of toner splashing in actual printing for a long period.

SUMMARY OF THE INVENTION

An object of the present invention is to provide a process for producing a toner which has low-temperature fixability and is less splashed in actual printing for a long period even in the case that a crystalline resin is contained in the toner.

The present inventors have found that proper control of the domain diameter and state of being of a crystalline resin in a toner is important to obtain a toner which has excellent low-temperature fixability and is less splashed in actual printing for a long period, and that the domain diameter and state of being of a crystalline resin in a toner can be finely controlled by customizing a heat treatment scheme in producing a toner through an emulsion aggregation method. The present invention was made on the basis of such findings.

In order to achieve the object mentioned above, a process for producing a toner, reflecting one aspect of the present invention includes: a first step of heating a dispersion containing an aqueous medium and a binder resin containing a crystalline resin to a temperature higher than or equal to a melting point of the crystalline resin in a step of aggregating and fusing a fine particle of the binder resin containing the crystalline resin to produce a toner base particle; a second step of cooling the dispersion having been heated in the first step and having a temperature higher than a recrystallization temperature Rc of the crystalline resin to a temperature lower than the Rc at a temperature-lowering rate of 1° C./min or higher; and a third step of maintaining the dispersion having been cooled in the second step at a temperature higher than or equal to the Rc−25° C. and lower than or equal to the Rc−5° C. for 30 minutes or longer.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
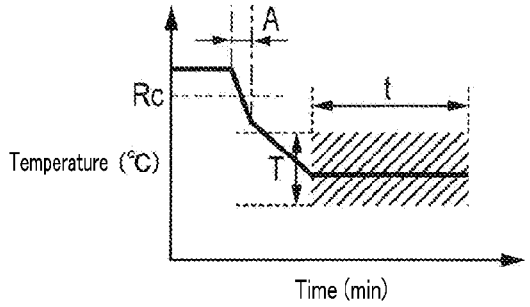
FIG. 1A is a graph showing a first example of the temperature change of a dispersion in the second step and the third step of the present invention.

Now, embodiments of the present invention will be described.

A process for producing a toner according to one embodiment of the present invention includes: a first step of heating a dispersion containing an aqueous medium and a binder resin containing a crystalline resin to a temperature higher than or equal to the melting point of the crystalline resin in a step of aggregating and fusing a fine particle of the binder resin containing the crystalline resin to produce a toner base particle; a second step of cooling the dispersion having been heated in the first step and having a temperature higher than the recrystallization temperature Rc of the crystalline resin to a temperature lower than Rc at a temperature-lowering rate of 1° C./min or higher; and a third step of maintaining the dispersion having been cooled in the second step at a temperature higher than or equal to Rc−25° C. and lower than or equal to Rc−5° C. for 30 minutes or longer. Each step will be described in the following.

[First Step]

The first step is a step of heating a dispersion containing an aqueous medium and a binder resin containing a crystalline resin to a temperature higher than or equal to the melting point (Tm) of the crystalline resin in the toner base particle in a step of producing a toner base particle. The temperature of the dispersion in the first step is not limited and may be any temperature higher than or equal to the melting point of the crystalline resin, and the upper limit is the boiling point of the aqueous medium (e.g., the boiling point of water). For heating the dispersion, a known heating apparatus such as a heater may be used. The melting point of the crystalline resin can be measured in DSC to be described later.

[Aqueous Medium]

The aqueous medium refers to a medium having a water content of 50 mass % or more. Examples of components other than water include water-soluble organic solvents such as methanol, ethanol, isopropanol, butanol, acetone, methyl ethyl ketone, and tetrahydrofuran. Among them, alcohol organic solvents which do not dissolve resins therein are particularly preferred, such as methanol, ethanol, isopropanol, and butanol.

[Toner Base Particle]

The toner base particle is formed by aggregating and fusing a fine particle of a binder resin containing a crystalline resin. For example, a dispersion prepared by dispersing a fine particle of a binder resin containing a crystalline resin in an aqueous medium is heated to aggregate and fuse the fine particle of a binder resin.

An aggregating agent may be used to aggregate the fine particle of a binder resin. The aggregating agent is not limited and is suitably an aggregating agent selected from metal salts, which are aggregating agents allowing a particle to grow through charge neutralization reaction and cross-linking action. Examples of such metal salts include salts of monovalent metals including alkali metal such as sodium, potassium, and lithium; salts of divalent metals such as calcium, magnesium, manganese, and copper; and salts of trivalent metals such as iron and aluminum. Specific examples of metal salts include sodium chloride, potassium chloride, lithium chloride, calcium chloride, magnesium chloride, zinc chloride, copper sulfate, magnesium sulfate, and manganese sulfate. Among them, it is particularly preferred to use salts of divalent metals because they can promote aggregation in a smaller amount. One of them may be used singly, or two or more thereof may be used in combination.

The aggregating agent added allows the fine particle of a binder resin to bond together through ionic crosslinking in the aqueous medium, and thus the state of being of the crystalline resin can be more advantageously controlled in heat treatment.

The growth of an aggregated particle can be substantially terminated by raising the salt concentration of the aqueous medium. For example, sodium chloride, or a polyvalent organic acid or a salt thereof, an amino acid or a salt thereof, or a polyphosphonic acid or a salt thereof may be used as an aggregation terminator. Alternatively, aggregating action can be reduced by changing the pH in the system. For pH adjustment, for example, an aqueous solution of sodium fumarate, an aqueous solution of sodium hydroxide, or hydrochloric acid, may be used. In addition, use of a chelating agent in combination with pH adjustment is effective for reduction of crosslinking action derived from a metal ion. Examples of such chelating agents include HIDA (hydroxyethyliminodiacetic acid), HEDTA (hydroxyethylethylenediaminetriacetic acid), HEDP (hydroxyethylidenediphosphonic acid), and HIDS (3-hydroxy-2,2'-iminodisuccinic acid).

The average circularity of a toner base particle to be obtained can be controlled in an aging step for aging of a toner base particle. In an aging step, a dispersion of a toner base particle is heated to age the toner base particle until an intended average circularity is imparted to the toner base particle.

The toner base particle may have a core-shell structure. In the case that a toner base particle having a core-shell structure is formed, a shell layer is formed on the surface of a toner base particle as a core particle. Specifically, a resin to constitute a shell layer is dispersed in an aqueous medium to prepare a resin particle dispersion, which is added to a dispersion of a toner base particle obtained in a formation step or aging step for a toner base particle to aggregate and fuse the resin particle as a shell layer on the surface of the toner base particle. In this way, a dispersion of a toner base particle having a core-shell structure can be obtained. To aggregate and fuse the resin particle as the shell layer on the core particle more strongly, heat treatment may be performed after the shell formation step. Heat treatment is suitably performed until an intended average circularity is imparted to the toner base particle.

For aggregation/fusion reaction, an additional toner material other than the binder resin may be further added to the dispersion of the fine particle of the binder resin, as long as the advantageous effects of the present invention are exerted. Examples of toner materials other than the binder resin include a coloring agent, a release agent, a charging-controlling agent, and a surfactant, each to be described later. One or more of the additional components may be contained. In the case that an additional toner material is added, a dispersion separately prepared and containing a fine particle of an additional toner material such as a coloring agent may be mixed with the dispersion containing the fine particle of the binder resin for the aggregation/fusion reaction.

Although the toner base particle produced as described above may be taken out of the dispersion before being subjected to a later step, the toner base particle is preferably subjected to a later step while being kept in the dispersion.

[Fine Particle of Binder Resin]

The fine particle of the binder resin can be produced by using an emulsion polymerization method in which a monomer of a resin is added to an aqueous medium together with a polymerization initiator and the monomer is allowed to undergo polymerization reaction to obtain a dispersion of a resin particle. The emulsion polymerization method can be performed in multiple stages. In the case of polymerization reaction in three stages, for example, a dispersion of a resin particle is prepared in the first stage of polymerization, and a monomer of a resin and a polymerization initiator are further added in the dispersion for the second stage of polymerization. To the dispersion prepared in the second stage of polymerization, a monomer of a resin and a polymerization initiator are further added for the third stage of polymerization. In the second and third stages of polymerization, a newly added monomer can be additionally polymerized with the resin particle generated in the previous polymerization, as a seed, in the dispersion, and thus the particle size, etc., of the resin particle can be homogenized. Use of a different monomer in each stage of polymerization reaction can provide the resin particle with a multilayer structure and readily provide a resin particle having intended characteristics.

(Polymerization Initiator)

A known polymerization initiator may be used in the polymerization reaction, and examples thereof include persulfates such as ammonium persulfate, sodium persulfate, and potassium persulfate; azo compounds such as 2,2'-azobis(2-aminodipropane) hydrochloride, 2,2'-azobis-(2-aminodipropane) nitrate, 4,4'-azobis-4-cyanovaleric acid, and poly(tetraethylene glycol-2,2'-azobisisobutyrate); and peroxides such as hydrogen peroxide.

The amount of the polymerization initiator to be added depends on intended molecular weight and molecular weight distribution, and specifically, can be 0.1 to 5.0 mass % based on the amount of a polymerizable monomer added.

(Chain Transfer Agent)

A chain transfer agent may be added in the polymerization reaction from the viewpoint of controlling the molecular weight of the resin particle. Examples of chain transfer agents which can be used include mercaptans such as octyl mercaptan; and mercaptopropionates such as n-octyl-3-mercaptopropionate. The amount of the chain transfer agent to be added depends on intended molecular weight and molecular weight distribution, and specifically, can be 0.1 to 5.0 mass % based on the amount of a polymerizable monomer added.

(Surfactant)

A surfactant may be added in the polymerization reaction from the viewpoint of preventing the aggregation of the resin fine particle in the dispersion, etc., to maintain a satisfactory dispersion state. Examples of such surfactants include known surfactants including cationic surfactants such as dodecylammonium bromide and dodecyltrimethylammonium bromide; anionic surfactants such as sodium stearate, sodium laurate (sodium dodecylsulfate), and sodium dodecylbenzenesulfonate; and nonionic surfactants such as dodecyl polyoxyethylene ether and hexadecyl polyoxyethylene ether. One of them may be used singly, or two or more thereof may be used in combination.

[Second Step]

The second step is a step of cooling the dispersion obtained in the first step. Specifically, the dispersion having been heated to a temperature higher than the recrystallization temperature Rc of the crystalline resin, which is measured by using a method to be described later, is cooled to a temperature lower than Rc at a temperature-lowering rate (cooling rate) of 1° C./min or higher. Then, the dispersion is suitably cooled so that the temperature-lowering rate at Rc is 1° C./min or higher. "The temperature of the dispersion having been heated to a temperature higher than Rc" may be the temperature at the end of the first step, or a predetermined temperature higher than Rc to which the dispersion is cooled from the temperature at the end of the first step. Accordingly, the dispersion having been heated in the first step may be immediately cooled to a temperature lower than Rc at a temperature-lowering rate of 1° C./min or higher, or the dispersion may be cooled to a predetermined temperature higher than Rc at an arbitrary cooling rate and then cooled to a temperature lower than Rc at a temperature-lowering rate of 1° C./min or higher. In addition, the cooling rate after reaching Rc is not limited. For example, the cooling rate may be controlled to lower than 1° C./min after the dispersion is cooled to a predetermined temperature lower than Rc at a temperature-lowering rate of 1° C./min or higher.

The dispersion can be cooled by using a known cooler capable of providing the above cooling rate. For example, an outer bath of a reaction vessel may be quickly cooled, or the dispersion may be allowed to pass through a heat exchanger, or cooled ion-exchanged water may be charged into the dispersion. From the viewpoint of production efficiency, cooling with a heat exchanger is preferred.

Rc, which is a temperature at which crystallization of a crystalline resin progresses at the greatest level, is a value determined as a peak top temperature of an exothermic peak in a measurement curve obtained in a temperature-lowering operation in differential scanning calorimetry (hereinafter, also referred to as "DSC") in which the temperature of a crystalline resin is raised from room temperature to 100° C. at a temperature-elevating rate of 10° C./min, retained for 1 minute, and lowered to 0° C. at a temperature-lowering rate of 0.1° C./min. The reason for setting the temperature-lowering rate to 0.1° C./min is that the crystallization temperature obtained at a temperature-lowering rate as low as possible is highly correlated with the performance of a toner obtained by using the process for producing a toner according to the present invention and the temperature-lowering rate of 0.1° C./min provides a sufficient correlation.

The temperature to which the dispersion is to be cooled in the second step is not limited and may be any temperature lower than Rc. However, cooling to a temperature lower than Rc−25° C. is preferred from the viewpoint of prevention of toner splashing.

The cooling rate at Rc for the dispersion is preferably 2° C./min or higher from the viewpoint of prevention of toner splashing. A higher cooling rate is more preferred from the viewpoint of prevention of toner splashing. The cooling rate is more preferably 2° C./min or higher and even more preferably 5° C./min or higher. If the cooling rate is too high, however, few crystal nuclei are formed in cooling and crystallization progresses more slowly, and thus the upper limit of the cooling rate is preferably 25° C./min or lower from the viewpoint of productivity.

[Third Step]

The third step is a step of maintaining the temperature of the dispersion having been cooled in the second step at a temperature higher than or equal to Rc−25° C. and lower than or equal to Rc−5° C. for 30 minutes or longer (hereinafter, also referred to as "heat treatment" simply).

During the heat treatment, it is only required to maintain the dispersion at a temperature higher than or equal to Rc−25° C. and lower than or equal to Rc−5° C., and the mode of temperature change of the dispersion from the initiation of the heat treatment to the termination thereof is not limited. For example, the temperature of the dispersion may be retained during the heat treatment, or may be constantly elevated or lowered at a constant rate, or may continuously vary so that, for example, elevation and lowering are repeated.

The temperature in the heat treatment is preferably higher than or equal to Rc−25° C. and lower than or equal to Rc−10° C. from the viewpoint of enhancement of the low-temperature fixability and prevention of toner splashing. The duration of the heat treatment is suitably 30 minutes or longer and the upper limit is not limited. However, the upper limit of the duration of the heat treatment is preferably approximately 180 minutes from the viewpoint of production efficiency. Performing the heat treatment step in an aqueous medium can prevent the change of the adsorption state of water molecules in a toner, and as a result the elevation of the glass transition temperature of the binder resin can be prevented.

[Description of Temperature Change of Dispersion in Second Step and Third Step]

Examples of the temperature change of the dispersion in the second step and the third step in the present invention will be described in the following with reference to FIGS. 1A to 1F. In the accompanying drawings, T indicates a temperature region of higher than or equal to Rc−25° C. and lower than or equal to Rc−5° C., t indicates a duration of 30 minutes or longer, A indicates a zone of the second step, and a shaded area indicates a duration and temperature region of the third step.

In the first example, as illustrated in FIG. 1A, (1) the dispersion having been heated to a temperature higher than Rc in the first step is cooled to a predetermined temperature lower than Rc (pre-heat treatment temperature) at a cooling rate of 1° C./min or higher (the second step), (2) the dispersion is then cooled to a heat treatment initiation temperature in the temperature region T at a cooling rate of lower than 1° C./min, and (3) finally the temperature of the dispersion is retained at the heat treatment initiation temperature for the duration t (the third step).

Figure 1D:
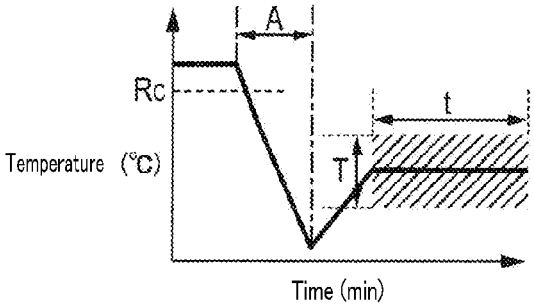
FIG. 1D is a graph showing a fourth example of the temperature change of a dispersion in the second step and the third step of the present invention.
Figure 1B:
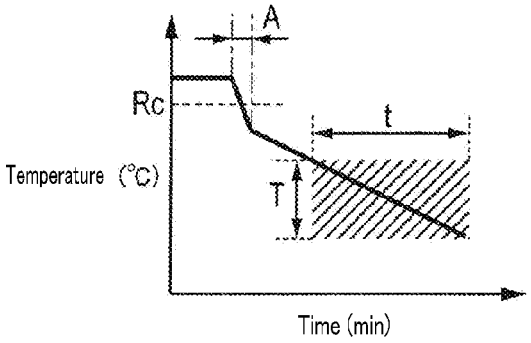
FIG. 1B is a graph showing a second example of the temperature change of a dispersion in the second step and the third step of the present invention.

In the second example, as illustrated in FIG. 1B, (1) the dispersion having been heated to a temperature higher than Rc in the first step is cooled to a predetermined temperature lower than Rc (pre-heat treatment temperature) at a cooling rate of 1° C./min or higher (the second step), (2) the dispersion is then cooled continuously at a cooling rate of lower than 1° C./min to maintain the temperature of the dispersion within the temperature region T for the duration t (the third step). In the second example, in contrast to the first example, the temperature of the dispersion is lowered at a constant rate in the third step.

Figure 1E:
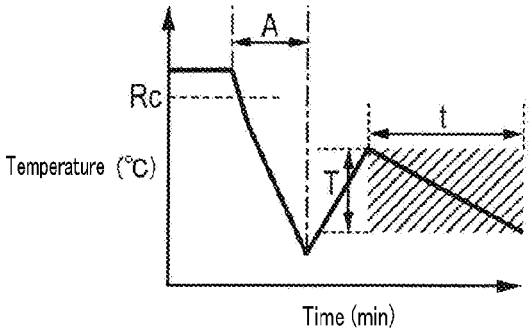
FIG. 1E is a graph showing a fifth example of the temperature change of a dispersion in the second step and the third step of the present invention.
Figure 1C:
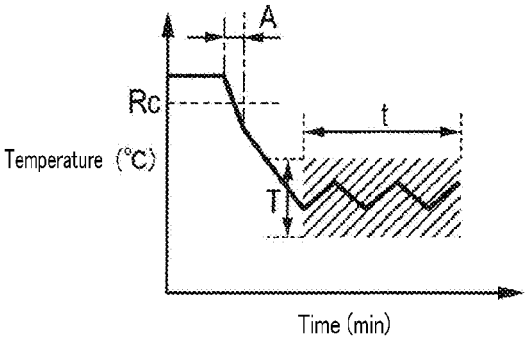
FIG. 1C is a graph showing a third example of the temperature change of a dispersion in the second step and the third step of the present invention.

In the third example, as illustrated in FIG. 1C, (1) the dispersion having been heated to a temperature higher than Rc in the first step is cooled to a predetermined temperature lower than Rc (pre-heat treatment temperature) at a cooling rate of 1° C./min or higher (the second step), (2) the dispersion is then cooled to a heat treatment initiation temperature in the temperature region T at a cooling rate of lower than 1° C./min, and (3) finally the dispersion is repeatedly heated and cooled to elevate and lower the temperature of the dispersion repeatedly in a manner such that the temperature of the dispersion is maintained within the temperature region T for the duration t (the third step). In contrast to the first example and the second example, the temperature of the dispersion is repeatedly elevated and lowered in the third step.

In the fourth example, as illustrated in FIG. 1D, (1) the dispersion having been heated to a temperature higher than Rc in the first step is cooled to a temperature lower than Rc−25° C. (pre-heat treatment temperature) at a cooling rate of 1° C./min or higher (the second step), (2) the dispersion is then heated to a heat treatment initiation temperature within the temperature region T, and (3) finally the temperature of the dispersion is retained at the heat treatment initiation temperature for the duration t (the third step). In contrast to the first example, the dispersion having a temperature higher than Rc is cooled to a temperature lower than Rc−25° C. at a cooling rate of 1° C./min or higher, and then heated.

In the fifth example, as illustrated in FIG. 1E, (1) the dispersion having been heated to a temperature higher than Rc in the first step is cooled to a temperature lower than Rc−25° C. (pre-heat treatment temperature) at a cooling rate of 1° C./min or higher (the second step), (2) the dispersion is then heated to a heat treatment initiation temperature of Rc−5° C., and (3) finally the dispersion is continuously cooled in a manner such that the temperature of the dispersion is maintained within the temperature region T for the duration t (the third step). In contrast to the second example, the dispersion having a temperature higher than Rc is cooled to a temperature lower than Rc−25° C. at a cooling rate of 1° C./min or higher, and then heated.

Figure 1F:
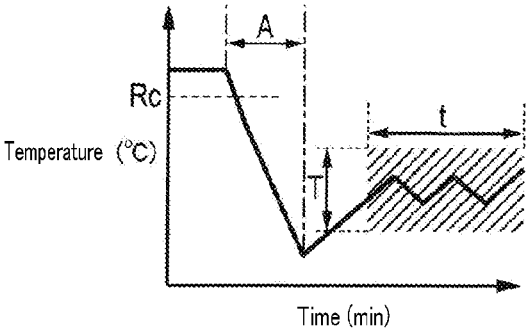
FIG. 1F is a graph showing a sixth example of the temperature change of a dispersion in the second step and the third step of the present invention.

In the sixth example, as illustrated in FIG. 1F, (1) the dispersion having been heated to a temperature higher than Rc in the first step is cooled to a temperature lower than Rc−25° C. (pre-heat treatment temperature) at a cooling rate of 1° C./min or higher (the second step), (2) the dispersion is then heated to a heat treatment initiation temperature within the temperature region T, and (3) finally the dispersion is repeatedly heated and cooled to elevate and lower the temperature of the dispersion repeatedly in a manner such that the temperature of the dispersion is maintained within the temperature region T for the duration t (the third step). In contrast to the third example, the dispersion having a temperature higher than Rc is cooled to a temperature lower than Rc−25° C. at a cooling rate of 1° C./min or higher, and then heated.

Thus, in the process for producing a toner according to the present embodiment, the dispersion containing the binder resin is cooled in a manner such that the cooling rate at Rc is 1° C./min or higher, and then the temperature of the dispersion is maintained within Rc−25° C. or higher and Rc−5° C. or lower for 30 minutes or longer.

The process for producing a toner according to the present embodiment may further include an additional step other than the above-described first to third steps, as long as the advantageous effects of the present embodiment are exerted. Examples of the additional step include a step of mixing an external additive with the resultant toner base particle to allow the external additive to attach to the toner base particle to obtain a toner particle, and a step of mixing the resultant toner particle with a carrier particle to obtain a toner as a two-component developer.

[Toner]

A toner produced by using the production process according to the present embodiment contains, as described above, a toner base particle at least containing a binder resin, and the toner base particle is a particle primarily composed of a binder resin and, as necessary, containing various additives such as a coloring agent, a release agent, a charging-controlling agent, and a surfactant. First, the binder resin will be described.

[Binder Resin]

The binder resin contains a crystalline resin and an amorphous resin. In the present specification, "the binder resin contains a crystalline resin" may refer to a mode in which the binder resin contains a crystalline resin itself, or may refer to a mode in which the binder resin contains a segment of a crystalline resin contained in another resin, as a crystalline polyester polymerization segment in a hybrid crystalline polyester resin to be described later. In the present specification, "the binder resin contains an amorphous resin" may refer to a mode in which the binder resin contains an amorphous resin itself, or may refer to a mode in which the binder resin contains a segment of an amorphous resin contained in another resin, as an amorphous resin segment in a hybrid crystalline polyester resin to be described later.

(Crystalline Resin)

The crystalline resin is a resin which does not undergo a stepwise endothermic change and has a clear endothermic peak in DSC for a toner. Specifically, a clear endothermic peak refers to an endothermic peak whose full width at half maximum is within 15° C. in DSC carried out at a temperature-elevating rate of 10° C./min. The content of such a crystalline resin is preferably 3 to 30 mass % based on the amount of a toner. This can provide an effect of improving the sharp melting properties of the binder resin to enhance the low-temperature fixability of a toner, and prevent lowering of the heat resistance caused by the crystalline resin contained.

Examples of the crystalline resin include crystalline polyester resins, crystalline polyamide resins, crystalline polyurethane resins, crystalline polyacetal resins, crystalline polyethylene terephthalate resins, crystalline polybutylene terephthalate resins, crystalline polyphenylene sulfide resins, crystalline polyether ether ketone resins, and crystalline polytetrafluoroethylene resins. Among them, crystalline polyester resins are preferred. The reason is that a crystalline polyester resin melts in heat fixation to serve as a plasticizer for an amorphous resin, and thus the low-temperature fixability can be enhanced. Such a crystalline polyester resin can be obtained by using a known synthesis method through dehydration condensation reaction between a polycarboxylic acid and a polyalcohol. One crystalline polyester resin or more than one crystalline polyester resin may be used.

Examples of the polycarboxylic acid include saturated aliphatic dicarboxylic acids such as succinic acid, sebacic acid, and dodecanedioic acid; alicyclic dicarboxylic acids such as cyclohexanedicarboxylic acids; aromatic dicarboxylic acids such as phthalic acid, isophthalic acid, and terephthalic acid; trivalent or higher polycarboxylic acids such as trimellitic acid and pyromellitic acid; acid anhydrides thereof; and $C_{1-3}$ alkyl esters thereof. The polycarboxylic acid is preferably an aliphatic dicarboxylic acid.

Examples of the polyalcohol include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; trihydric or higher alcohols such as glycerin, pentaerythritol, trimethylolpropane, and sorbitol. The polyalcohol is preferably an aliphatic diol.

The crystalline polyester resin is preferably a hybrid crystalline polyester resin modified with a styrene-acrylic resin (hereinafter, simply referred to as "hybrid crystalline polyester resin"). The reason is that the styrene-acrylic resin portion of a hybrid crystalline polyester resin has high compatibility with an amorphous resin and the crystalline polyester resin can be homogeneously dispersed in the toner base particle; and in the case that the toner base particle has a core-shell structure to be described later and the shell layer contains a hybrid crystalline polyester resin, the styrene-acrylic resin portion tends to aggregate on the surface of the core particle containing an amorphous resin and cover the whole surface of the core particle.

In the present invention, "a crystalline polyester resin is modified with a styrene-acrylic resin" refers to a state in which a crystalline polyester resin segment and a styrene-acrylic resin segment chemically bond to each other. A crystalline polyester resin segment refers to a resin portion derived from a crystalline polyester resin, that is, a molecular chain having the same chemical structure as the crystalline polyester resin, in a hybrid crystalline polyester resin. A styrene-acrylic resin segment refers to a resin portion derived from a styrene-acrylic resin, that is, a molecular chain having the same chemical structure as the styrene-acrylic resin, in a hybrid crystalline polyester resin.

The styrene-acrylic resin is a polymer of a styrenic monomer and a (meth)acrylic monomer.

Examples of the styrenic monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives thereof. One of them may be used singly, or two or more thereof may be used in combination.

Examples of the (meth)acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl 6-hydroxyacrylate, propyl γ-aminoacrylate, stearyl methacrylate, dimethylaminoethyl methacrylate, diethylaminoethyl methacrylate, 2-hydroxyethyl (meth) acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono(meth)acrylate. One of them may be used singly, or two or more thereof may be used in combination.

In addition to the styrenic monomer and the (meth)acrylic monomer, an additional monomer may be used. Examples of the additional monomer which can be used include maleic acid, itaconic acid, cinnamic acid, fumaric acid, monoalkyl maleates, and monoalkyl itaconates.

The styrene-acrylic resin can be obtained by adding an arbitrary common polymerization initiator such as a peroxide, a persulfate, and an azo compound and polymerizing the above-described monomers by using a known polymerization method such as bulk polymerization, solution polymerization, an emulsion polymerization method, a miniemulsion method, a suspension polymerization method, and a dispersion polymerization method. In polymerization, a common chain transfer agent such as an alkyl mercaptan and a mercapto fatty acid ester may be used for the purpose of adjusting the molecular weight.

The content of the styrene-acrylic resin segment in the hybrid crystalline polyester resin is preferably 1 to 30 mass % because the plasticity of a toner particle can be easily controlled.

The hybrid crystalline polyester resin can be obtained by allowing the crystalline polyester resin and the styrene-acrylic resin each separately prepared to react and chemically bond to each other.

From the viewpoint of facilitating bonding, it is preferred to incorporate a substituent capable of reacting with both of the crystalline polyester resin and the styrene-acrylic resin into either the crystalline polyester resin or the styrene-acrylic resin. In formation of the styrene-acrylic resin, for example, a compound having a substituent capable of reacting with a carboxy group (COOH) or a hydroxy group (OH) in the crystalline polyester resin and a substituent capable of reacting with the styrene-acrylic resin is added in addition to the styrenic monomer and the (meth)acrylic monomer as raw materials. This provides a styrene-acrylic resin having a substituent capable of reacting with a carboxy group (COOH) or a hydroxy group (OH) in the crystalline polyester resin.

Alternatively, the hybrid crystalline polyester resin can be obtained by performing polymerization reaction in the presence of the crystalline polyester resin prepared in advance to produce the styrene-acrylic resin, or by performing polymerization reaction in the presence of the styrene-acrylic resin prepared in advance to produce the crystalline polyester resin. In both cases, a compound having a substituent capable of reacting with both of the crystalline polyester resin and the styrene-acrylic resin as described above is suitably added in polymerization reaction.

The number average molecular weight (Mn) of the hybrid crystalline polyester resin is preferably 2,000 to 10,000 from the viewpoint of fixability.

The melting point (Tm) of the crystalline resin according to the present embodiment is preferably 50 to 90° C., and more preferably 60 to 80° C. from the viewpoint of obtaining sufficient low-temperature fixability and high-temperature storability.

The melting point (Tm) of the crystalline resin can be measured in DSC. Specifically, a sample of the crystalline resin is sealed in the aluminum pan KITNO.B0143013, and the pan is attached to a sample holder of the thermal analyzer Diamond DSC (manufactured by PerkinElmer Inc.), and the temperature is changed by heating, cooling, and heating, in the order presented. In the first and second heating, the temperature is elevated from room temperature (25° C.) to 150° C. at a temperature-elevating rate of 10° C./min and the temperature is retained at 150° C. for 5 minutes, and in the cooling, the temperature is lowered from 150° C. to 0° C. at a temperature-lowering rate of 10° C./min and the temperature is retained at 0° C. for 5 minutes. A peak top temperature of an exothermic peak in an exothermic curve obtained in the second heating is measured as the melting point (Tm).

The content of the crystalline polyester resin in the binder resin is preferably 5 to 50 mass %. If the content of the crystalline polyester resin in the binder resin is less than 5 mass %, the effect of low-temperature fixing may be lowered, and if the content of the crystalline polyester resin in the binder resin is more than 50 mass %, the high-temperature storability may be deteriorated. The content of the crystalline resin in the toner base particle is preferably 1 to 20 mass %, and more preferably 5 to 15 mass % from the viewpoint of obtaining sufficient low-temperature fixability and high-temperature storability. An amorphous vinyl resin to be described later homogeneously disperses the crystalline resin the content of which is within the range in a toner particle and crystallization can be sufficiently inhibited.

It is preferable that the weight average molecular weight (Mw) of the crystalline resin according to the present embodiment be 5,000 to 50,000, and the number average molecular weight (Mn) thereof be 2,000 to 10,000 from the viewpoint of low-temperature fixability and glossiness stability.

The weight average molecular weight (Mw) and the number average molecular weight (Mn) can be determined from a molecular weight distribution measured by using gel permeation chromatography (GPC), as in the following.

A sample is added to tetrahydrofuran (THF) so that the concentration reaches 1 mg/mL, and dispersed with an ultrasound disperser at room temperature for 5 minutes, and the resultant is processed by using a membrane filter with a pore size of 0.2 μm to prepare a sample solution. With use of the GPC apparatus HLC-8120GPC (manufactured by Tosoh Corporation) and TSKguardcolumn+TSKgelSuperHZ-m (manufactured by Tosoh Corporation) in a triple column, tetrahydrofuran as a carrier solvent is allowed to flow through at a flow rate of 0.2 mL/min with the column temperature retained at 40° C. Together with the carrier solvent, 10 μL of the sample solution prepared is injected into the GPC apparatus. The sample is detected with a refractive index detector (RI detector), and the molecular weight distribution of the sample is calculated by using a calibration curve obtained in measurement for a monodisperse polystyrene standard particle. Ten polystyrenes are used for determination of the calibration curve.

(Amorphous Resin)

Amorphous resins are resins with amorphous characteristics, which are characterized in having a glass transition temperature (Tg) but having no melting point, that is, having no clear endothermic peak when the temperature is elevated, as described above, in an endothermic curve obtained in DSC.

The amorphous resin is used as the binder resin together with the crystalline resin, and constitutes the toner base particle. One amorphous resin or more than one amorphous resin may be used. The amorphous resin may be a vinyl resin, or a urethane resin, a urea resin, an amorphous polyester resin or a modified polyester resin a part of which has been modified, or a combination thereof. The amorphous resin is also available, for example, through a known synthesis method. The amorphous resin is preferably a vinyl resin from the viewpoint of enhancement of low-temperature stability and high-temperature storability.

(Amorphous Vinyl Resin)

The amorphous vinyl resin is not limited and may be any amorphous vinyl resin obtained by polymerizing a vinyl compound, and examples thereof include acrylate resins, styrene-acrylate resins, and ethylene-vinyl acetate resins. One of them may be used singly, or two or more thereof may be used in combination. Among them, styrene-acrylate resins (styrene-acrylic resins) are preferred in view of plasticity in heat fixation.

The amorphous vinyl resin preferably has a weight average molecular weight (Mw) of 20,000 to 150,000 and a number average molecular weight (Mn) of 5,000 to 20,000 from the viewpoint of achieving fixability and hot offset resistance simultaneously. The weight average molecular weight (Mw) and the number average molecular weight (Mn) can be measured in the same manner as in the case of the crystalline resin.

The glass transition temperature (Tg) of the amorphous vinyl resin is preferably 20 to 70° C. from the viewpoint of achieving fixability and high-temperature storability simultaneously.

The glass transition temperature (Tg) can be measured in accordance with the method defined in ASTM (American Society for Testing Materials standard) D3418-82 (DSC). For measurement, a DSC-7 differential scanning colorimeter (manufactured by PerkinElmer Inc.), a TAC7/DX thermal analysis controller (manufactured by PerkinElmer Inc.), etc., can be used.

The amorphous vinyl resin may be a polymer consisting only of a monomer or a copolymer consisting of the monomer and an additional monomer. For the additional monomer, a styrenic monomer such as styrene and a styrene derivative, etc., may be used.

(Amorphous Polyester Resin)

Among polyester resins obtained through polycondensation reaction between a divalent or higher carboxylic acid (polycarboxylic acid) and a dihydric or higher alcohol (polyalcohol), amorphous polyester resins are polyester resins with amorphous characteristics. In the case that a toner having a core-shell structure is formed, an amorphous polyester resin may be used for a material of the shell layer.

For the polycarboxylic acid and the polyalcohol, the materials described above for the crystalline polyester resin may be used.

The ratio between the polycarboxylic acid and the polyalcohol is preferably 1.5/1 to 1/1.5, and more preferably 1.2/1 to 1/1.2 in an equivalent ratio of the hydroxy group of the polyalcohol to the carboxy group of the polycarboxylic acid, [OH]/[COOH].

The number average molecular weight (Mn) of the amorphous polyester resin is preferably 2,000 to 10,000. The number average molecular weight (Mn) can be measured in the same manner as in the case of the amorphous vinyl resin.

The glass transition temperature (Tg) of the amorphous polyester resin is preferably 20 to 70° C. The glass transition temperature (Tg) can be measured in the same manner as in the case of the amorphous vinyl resin.

The amorphous polyester resin may be, as the above-described crystalline polyester resin, a hybrid amorphous polyester resin modified with a styrene-acrylic resin (hereinafter, simply referred to as "hybrid amorphous polyester resin").

The styrene-acrylic resin portion of the hybrid amorphous polyester resin has high compatibility with an amorphous vinyl resin and the amorphous polyester resin can be homogeneously dispersed in the toner base particle. In the case that the toner base particle has a core-shell structure and the shell layer contains the hybrid amorphous polyester resin, aggregation of the hybrid amorphous polyester resin tends to occur on the surface of the core particle containing an amorphous vinyl resin and the whole surface tends to be covered.

In the present invention, "an amorphous polyester resin is modified with a styrene-acrylic resin" refers to a state in which an amorphous polyester resin segment and a styrene-acrylic resin segment chemically bond to each other. An amorphous polyester resin segment refers to a resin portion derived from an amorphous polyester resin, that is, a molecular chain having the same chemical structure as the amorphous polyester resin, in a hybrid resin. A styrene-acrylic resin segment refers to a resin portion derived from a styrene-acrylic resin, that is, a molecular chain having the same chemical structure as the styrene-acrylic resin, in a hybrid resin. The styrene-acrylic resin can be produced in the same manner by using the materials described above for the hybrid crystalline polyester resin.

The number average molecular weight (Mn) of the hybrid amorphous polyester resin is preferably 2,000 to 10,000 from the viewpoint of fixability.

The content of the amorphous polyester resin in the toner base particle is preferably 1 to 50 mass % from the viewpoint of fixability and environmental stability of charging.

[Coloring Agent]

For the coloring agent, a known inorganic or organic coloring agent as a coloring agent for a color toner is used. Examples of the coloring agent include carbon black, magnetic materials, pigments, and dyes. One coloring agent or more than one coloring agent may be used.

Examples of the carbon black include channel black, furnace black, acetylene black, thermal black, and lamp black. Examples of the magnetic material include ferromagnetic metals such as iron, nickel, and cobalt, alloys containing these metals, and compounds of ferromagnetic metals such as ferrite and magnetite.

Examples of the pigment include C. I. Pigment Reds 2, 3, 5, 7, 15, 16, 48:1, 48:3, 53:1, 57:1, 81:4, 122, 123, 139, 144, 149, 166, 177, 178, 208, 209, 222, 238, and 269; C. I. Pigment Oranges 31 and 43; C. I. Pigment Yellows 3, 9, 14, 17, 35, 36, 65, 74, 83, 93, 94, 98, 110, 111, 138, 139, 153, 155, 180, 181, and 185; C. I. Pigment Green 7; C. I. Pigment Blues 15:3, 15:4, and 60; and phthalocyanine pigments whose center metal is zinc, titanium, magnesium, or the like.

Examples of the dye include C. I. Solvent Reds 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176, and 179; pyrazolotriazole azo dye; pyrazolotriazole azomethine dye; pyrazolone azo dye; and pyrazolone azomethine dye; C. I. Solvent Yellows 19, 44, 77, 79, 81, 82, 93, 98, 103, 104, 112, and 162; and C. I. Solvent Blues 25, 36, 60, 70, 93, and 95.

[Release Agent]

Examples of the release agent (wax) include hydrocarbon waxes and ester waxes. Examples of the hydrocarbon wax include low-molecular weight polyethylene waxes, low-molecular weight polypropylene waxes, Fischer-Tropsch waxes, microcrystalline waxes, and paraffin waxes. Examples of the ester wax include carnauba waxes, pentaerythritol behenate, behenyl behenate, and behenyl citrate. One release agent or more than one release agent may be used.

[Charging-Controlling Agent]

Examples of the charging-controlling agent include nigrosine dyes; metal salts of naphthenic acid or higher fatty acids; alkoxylated amines; quaternary ammonium salt compounds; azo-metal complexes; and metal salicylate and metal complexes thereof. One charging-controlling agent or more than one charging-controlling agent may be used.

[Surfactant]

Examples of the surfactant include anionic surfactants such as sulfate ester salt surfactants, sulfonate salt surfactants, and phosphate ester surfactants; cationic surfactants such as amine salt surfactants and quaternary ammonium salt surfactants; and nonionic surfactants such as polyethylene glycol surfactants, alkylphenol-ethylene oxide adduct surfactants, and polyalcohol surfactants. One surfactant or more than one surfactant may be used.

Specific examples of the anionic surfactant include sodium dodecylbenzenesulfonate, sodium dodecylsulfate, sodium alkylnaphthalenesulfonates, and sodium dialkylsulfosuccinates. Specific examples of the cationic surfactant include alkylbenzenedimethylammonium chlorides, alkyltrimethylammonium chlorides, and distearylammonium chloride. Examples of the nonionic surfactant include polyoxyethylene alkyl ethers, glycerin fatty acid esters, sorbitan fatty acid esters, polyoxyethylenesorbitan fatty acid esters, and polyoxyethylene fatty acid esters.

[Structure of Toner Particle]

The structure of the toner particle according to the present embodiment may be a monolayer structure consisting only of the above-described toner particle, or a multilayer structure such as a core-shell structure which includes a core particle of the above-described toner particle and a shell layer covering the core particle and the surface thereof. The shell layer need not cover the whole surface of the core particle, and the core particle may be partially exposed. The cross section of the core-shell structure can be confirmed, for example, by using known means for observation such as a transmission electron microscope (TEM) and a scanning probe microscope (SPM).

In the case of the core-shell structure, the core particle and the shell layer can be different in properties such as glass transition temperature, melting point, and hardness, and toner particles can be designed in accordance with intended use. For example, a resin having a relatively high glass transition temperature (Tg) can be allowed to aggregate and fuse on the surface of the core particle containing a binder resin, a coloring agent, a release agent, etc., and having a relatively low glass transition temperature (Tg) to form the shell layer. As described above, an amorphous polyester resin can be used for the shell layer, and especially, an amorphous polyester resin modified with a styrene-acrylic resin can be preferably used.

[Melting Point]

The toner particle according to the present embodiment preferably has a melting point (Tm) of 60 to 90° C., and more preferably has a melting point (Tm) of 65 to 80° C. If the melting point is within the range, sufficient low-temperature fixability and high-temperature storability can be achieved simultaneously. In addition, the thermal resistance (thermal strength) of the toner can be maintained at a satisfactory level, and sufficient high-temperature storability can be obtained. The melting point (Tm) can be measured in the same manner as in the case of the crystalline polyester resin.

[Particle Size of Toner Particle]

The volume-based median diameter of the toner particle according to the present embodiment is preferably 3 to 8 μm, and more preferably 5 to 8 μm.

If the volume-based median diameter is within the range, high-resolution dots at approximately 1,200 dpi can be accurately reproduced.

The volume-based median diameter can be controlled through the concentration of an aggregating agent used in production, the amount of an organic solvent added, fusion time, the composition of the binder resin, etc.

The volume-based median diameter can be measured by using a measuring apparatus including a Multisizer 3 (manufactured by Beckman Coulter, Inc.) to which a computer system including the data analysis software Software v.3.51 is connected. Specifically, 0.02 g of a sample (toner) is added to 20 mL of a surfactant solution (e.g., a surfactant solution obtained by diluting a neutral detergent containing a surfactant component 10-fold with pure water for the purpose of dispersing a toner particle) and conditioned, and the resultant is then subjected to ultrasound dispersion for 1 minute to prepare a dispersion of a toner. The dispersion of a toner is injected with a pipet into a beaker containing an ISOTON II (manufactured by Beckman Coulter, Inc.) in a sample stand until the concentration displayed on the measuring apparatus reaches 8%. This concentration provides a reproducible measurement.

Then, the number of counts for particles to be measured and the aperture diameter for the measuring apparatus are set to 25,000 and 100 μm, respectively, and a measurement range of 2 to 60 μm is divided into 256 portions to calculate a frequency value for each portion, and the particle size at 50% from the largest cumulative volume percentage is determined as the volume-based median diameter.

[Average Circularity of Toner Particle]

In the toner according to the present embodiment, the average circularity of the toner particle is preferably 0.930 to 1.000, and more preferably 0.950 to 0.995.

If the average circularity is within the range, the toner particle can be prevented from breaking, and a friction-charging member can be prevented from being stained to stabilize the charging characteristics of the toner. In addition, an image formed with the toner has a high image quality.

The average circularity can be measured as follows. A dispersion of a toner is prepared in the same manner as in the case of measurement of a median diameter. With an FPIA-2100, an FPIA-3000, (both manufactured by Sysmex Corporation, "FPIA" is a registered trademark possessed by the company), or the like, an image of the dispersion of a toner is taken by using an HPF (high-magnification imaging) mode and a proper concentration range of 3,000 to 10,000 HPF detections, and the circularity of each toner particle is calculated by using equation (y). The circularities of the toner particles are added together, and the sum of the circularities is divided by the number of the toner particles to calculate the average circularity. If the number of HPF detections is within the proper concentration range, sufficient reproducibility can be obtained.

circularity=(peripheral length of circle having the same projection area as particle image)/(peripheral length of projected particle image) Equation (y)

[External Additive]

The toner particle according to the present embodiment may contain, for example, the toner base particle and an external additive present on the surface of the toner base particle. It is preferable that the toner particle contain an external additive from the viewpoint of controlling the fluidity, charging characteristics, etc., of the toner particle. One external additive or more than one external additive may be used. Examples of the external additive include a silica particle, a titania particle, an alumina particle, a zirconia particle, a zinc oxide particle, a chromium oxide particle, a cerium oxide particle, an antimony oxide particle, a tungsten oxide particle, a tin oxide particle, a tellurium oxide particle, a manganese oxide particle, and a boron oxide particle.

The external additive preferably contains a silica particle produced through a sol-gel method. Silica particles produced through a sol-gel method have a feature of a narrow particle size distribution, and thus are preferred from the viewpoint of suppressing variation of the attaching strength of the external additive to the toner base particle.

The number average primary particle size of the silica particle is preferably 70 to 200 nm. Silica particles having a number average primary particle size within the range are larger than other external additives. Accordingly, such a silica particle serves as a spacer in a two-component developer, and is preferred from the viewpoint of preventing other smaller external additives from being buried in the toner base particle while a two-component developer is stirred in a developing device. In addition, such a silica particle is preferred also from the viewpoint of preventing the toner base particle from fusing together.

The number average primary particle size of the external additive can be determined, for example, through image processing for an image taken with a transmission electron microscope, and can be adjusted, for example, through classification or mixing with a classified product.

The surface of the external additive preferably has been subjected to hydrophobization treatment. For the hydrophobization treatment, a known surface treating agent is used. One surface treating agent or more than one surface treating agent may be used, and examples thereof include silane coupling agents, silicone oils, titanate coupling agents, aluminate coupling agents, fatty acids, metal salts of fatty acids, esterified products thereof, and rosin acid.

Examples of the silane coupling agent include dimethyldimethoxysilane, hexamethyldisilazane (HMDS), methyltrimethoxysilane, isobutyltrimethoxysilane, and decyltrimethoxysilane. Examples of the silicone oil include cyclic compounds and linear or branched organosiloxanes, and more specifically include organosiloxane oligomers, octamethylcyclotetrasiloxane, decamethylcyclopentasiloxane, tetramethylcyclotetrasiloxane, and tetravinyltetramethylcyclotetrasiloxane.

Examples of the silicone oil include silicone oils which are highly reactive and at least one end of which is modified by introducing a modifying group to a side chain, one end, both ends, one end of a side chain, both ends of a side chain, or the like. One type of a modifying group or more than one type of modifying groups may be used, and examples of the modifying group include an alkoxy group, a carboxyl group, a carbinol group, a higher fatty acid modifying group, a phenol group, an epoxy group, a methacryl group, and an amino group.

The amount of the external additive to be added is preferably 0.1 to 10.0 mass %, and more preferably 1.0 to 3.0 mass % based on the total amount of the toner particle.

[Developer]

The toner is composed of the toner particle itself in the case of a one-component developer, and composed of the toner particle and a carrier particle in the case of a two-component developer. The content of the toner particle (toner concentration) in the two-component developer may be the same as that in common two-component developers, and for example, is 4.0 to 8.0 mass %.

The carrier particle is composed of a magnetic material. Examples of the carrier particle include a covered carrier particle including a core material particle consisting of the magnetic material and a covering material layer covering the surface of the core material particle, and a dispersion-in-resin type carrier particle including a fine particle of a magnetic material dispersed in a resin. The carrier particle is preferably the covered carrier particle from the viewpoint of preventing the carrier particle from attaching to a photoconductor.

The core material particle is composed of a magnetic material such as a substance which is strongly magnetized by a magnetic field in the direction of the magnetic field. One magnetic material or more than one magnetic material may be used, and examples thereof include ferromagnetic metals such as iron, nickel, and cobalt; alloys or compounds containing these metals; and alloys which exhibit ferromagnetic characteristics via heat treatment.

Examples of the ferromagnetic metal and compound containing it include iron, ferrite represented by formula (a), and magnetite represented by formula (b). M in formula (a) and formula (b) denotes one or more monovalent or divalent metals selected from the group consisting of Mn, Fe, Ni, Co, Cu, Mg, Zn, Cd, and Li.

$$MO.Fe_2O_3 \quad \text{Formula (a):}$$

$$MFe_2O_4 \quad \text{Formula (b):}$$

Examples of the alloy or metal oxide which exhibits ferromagnetic characteristics via heat treatment include Heusler alloys such as manganese-copper-aluminum alloys and manganese-copper-tin alloys; and chromium dioxide.

The core material particle is preferably the ferrite. The reason is that impact due to stirring in a developing device can be reduced because the specific gravity of the covered carrier particle is smaller than that of a metal constituting the core material particle.

One covering material or more than one covering material may be used. For the covering material, a known resin for covering a core material particle of a carrier particle may be used. The covering material is preferably a resin having a cycloalkyl group from the viewpoint of lowering of the moisture adsorptivity of the carrier particle and enhancement of the adhesion of the covering layer to the core material particle. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. Among them, a cyclohexyl group and cyclopentyl group are preferred, and a cyclohexyl group is more preferred from the viewpoint of the adhesion of the covering layer to a ferrite particle.

The weight average molecular weight Mw of the resin having a cycloalkyl group is, for example, 10,000 to 800,000, and more preferably 100,000 to 750,000. The content of the cycloalkyl group in the resin is, for example, 10 to 90 mass %. The content of the cycloalkyl group in the resin can be determined by using a known instrumental analysis method such as P-GC/MS and $^1$H-NMR.

The two-component developer can be produced by mixing the toner particle and the carrier particle in appropriate amounts. Examples of mixing apparatuses for the mixing include a Nauta mixer, and W-cone and V-shaped mixers.

The size and shape of the toner particle may be appropriately determined as long as the advantageous effects of the present embodiment can be obtained. For example, the volume average particle size of the toner particle is 3.0 to 8.0 μm, and the average circularity of the toner particle is 0.920 to 1.000.

The number average particle size of the toner particle can be measured and calculated by using an apparatus including a "Multisizer 3" (manufactured by Beckman Coulter, Inc.) to which a computer system for data processing is connected. The number average particle size can be adjusted, for example, through conditions for temperature and stirring, classification of the toner particle, or mixing with a classified product of the toner particle in producing the toner particle.

The average circularity of the toner particle can be determined as follows: determining a peripheral length L1 of a circle having the same projection area as a particle image and a peripheral length L2 of a projected particle image for each of a predetermined number of toner particles, for example, by using the flow-type particle image analyzer "FPIA-3000" (manufactured by Sysmex Corporation); calculating a circularity for each of the toner particles, and dividing the sum total of the circularities by the predetermined number. The average circularity of the toner particle can be adjusted, for example, through the degree of aging of the resin particle, heat treatment of the toner particle, or mixing with a toner particle having a different circularity in producing the toner particle.

$$C=L1/L2 \quad \text{Equation}$$

Similarly, the size and shape of the carrier particle may be appropriately determined as long as the advantageous effects of the present embodiment can be obtained. The volume average particle size of the carrier particle is, for example, 15 to 100 μm. The volume average particle size of the carrier particle can be measured, for example, by using a wet method with the laser diffraction particle size distribution measuring apparatus "HELOS KA" (manufactured by Japan Laser Corporation). The volume average particle size of the carrier particle can be adjusted, for example, through a method of controlling the particle size of the core material particle via production conditions for the core material particle, classification of the carrier particle, or mixing with a classified product of the carrier particle.

As described above, the process for producing a toner according to the present embodiment includes: a first step of heating a dispersion containing an aqueous medium and a binder resin containing a crystalline resin to a temperature higher than or equal to the melting point of the crystalline resin in a step of aggregating and fusing a fine particle of the binder resin containing the crystalline resin to produce a toner base particle; a second step of cooling the dispersion having been heated in the first step and having a temperature higher than the recrystallization temperature Rc of the crystalline resin to a temperature lower than the Rc at a temperature-lowering rate of 1° C./min or higher; and a third step of maintaining the dispersion having been cooled in the second step at a temperature higher than or equal to the Rc−25° C. and lower than or equal to the Rc−5° C. for 30 minutes or longer.

The present inventors have found that a crystalline resin can be recrystallized at a temperature around Rc in a short time but the domain diameter of the crystalline resin increases and the bleed out of the crystalline resin occurs in the surface of the toner due to the high crystallization rate, and thus it is important for controlling the domain diameter and state of being of a crystalline resin in a toner to properly control the recrystallization rate of the crystalline resin.

One of features of the process for producing a toner is that a toner can be obtained which has satisfactory low-temperature fixability and is less splashed in actual printing for a long period, and the reason is presumably as follows.

If the second step and the third step are carried out to recrystallize the crystalline resin which has been once heated to a temperature higher than or equal to the melting point and melted, the melted crystalline resin is recrystallized at a moderate rate, and thus the domain diameter of the crystalline resin does not increase too much and the crystalline resin is finely dispersed in a toner, without being localized in the vicinity of the surface of the toner, and the softened state of the amorphous resin is kept. Presumably for this reason, the low-temperature fixability is retained. Further, heat treatment in an aqueous medium prevents the change of the adsorption state of water molecules in the toner, which presumably prevents the elevation of the glass transition temperature of the binder resin and as a result the low-temperature fixability is retained. Furthermore, the crystalline resin is not exposed in the surface of the toner, and presumably for this reason, lowering of the surface resistance of the toner and deterioration of the charging characteristics of the toner are not caused and toner splashing due to them is prevented.

Maintaining the temperature of the dispersion at a temperature higher than or equal to the Rc−25° C. and lower than or equal to the Rc−10° C. for 30 minutes or longer in the third step is more effective in terms of the low-temperature fixability and the toner splashing characteristics.

Cooling the dispersion to a temperature lower than the Rc−25° C. in the second step is more effective in terms of prevention of toner splashing.

A cooling rate for the dispersion being 2° C./min or higher in the second step is more effective in terms of prevention of toner splashing.

The crystalline resin being a crystalline polyester resin is more effective in terms of improvement in low-temperature fixability.

The toner is applied to common electrophotographic image forming methods, and is used for development of electrostatic latent images.

The process for producing a toner according to the present embodiment enables fine control of the location and domain diameter of a crystalline resin in a toner even during the heat treatment, and, as a result, a toner can be produced which has low-temperature fixability and is less splashed in actual printing for a long period.

EXAMPLES

Hereinafter, the present invention will be described more specifically with reference to Examples and Comparative Examples, but the present invention is never limited to Examples below.

[Synthesis of Crystalline Polyester Resin and Preparation of Dispersion Thereof]

(Synthesis of Crystalline Polyester Resin 1)

The following raw material monomers of an addition polymerization resin (styrene-acrylic resin: StAc) segment, including bireactive monomers, and radical polymerization initiator were placed in a dropping funnel.

| | |
|---|---|
| Styrene | 36.0 parts by weight |
| n-Butyl acrylate | 13.0 parts by weight |
| Acrylic acid | 2.0 parts by weight |
| Polymerization initiator (di-t-butyl peroxide) | 7.0 parts by weight |

The following raw material monomers of a polycondensation resin (crystalline polyester resin: CPEs) segment were placed in a four-necked flask equipped with a nitrogen introduction tube, a dehydration tube, a stirrer, and a thermocouple, and heated to 170° C. to dissolve.

| | |
|---|---|
| Tetradecanedioic acid | 440 parts by weight |
| 1,4-Butanediol | 153 parts by weight |

Subsequently, the raw materials of an addition polymerization resin (StAc) were added dropwise to the resultant solution under stirring over 90 minutes, and the resultant was aged for 60 minutes and then unreacted addition-polymerizable monomers were removed under reduced pressure (8 kPa). The amount of the removed monomer was only a trace amount relative to the raw material monomer ratio of the resin. Thereafter, 0.8 parts by weight of $Ti(OBu)_4$ as an esterification catalyst was charged therein, and the temperature was elevated to 235° C., and reaction was performed under normal pressure (101.3 kPa) for 5 hours and then under reduced pressure (8 kPa) for 1 hour. The resultant was then cooled to 200° C. and subsequently allowed to react under reduced pressure (20 kPa) for 1 hour to afford crystalline polyester resin 1. The weight average molecular weight (Mw), melting point (mp), and recrystallization temperature (Rc) of crystalline polyester resin 1 obtained were 24,500, 75.5° C., and 70.6° C., respectively.

(Preparation of Crystalline Polyester Resin Particle Dispersion 1)

Crystalline polyester resin 1 in an amount of 100 parts by weight was dissolved in 400 parts by weight of ethyl acetate (manufactured by KANTO CHEMICAL CO., INC.), and the resultant was mixed with 638 parts by weight of a 0.26 mass % sodium laurylsulfate solution prepared in advance. The resultant mixed solution was subjected to ultrasound dispersion with the ultrasound homogenizer US-150T (manufactured by NISSEI Corporation) at 300 μA of V-LEVEL under stirring for 30 minutes. Thereafter, the resultant was warmed to 40° C., and at the temperature the ethyl acetate was completely removed with the diaphragm vacuum pump V-700 (manufactured by BUCHI Ladotechnik AG) under reduced pressure and stirring for 3 hours to prepare crystalline polyester resin particle dispersion 1. The crystalline polyester resin particle in the dispersion had a volume-based median diameter of 160 nm.

(Synthesis of Crystalline Polyester Resin 2)

In a reaction vessel equipped with a stirrer, a thermometer, a condenser, and a nitrogen introduction tube, 315 parts by weight of tetradecanedioic acid and 252 parts by weight of 1,4-butanediol were placed. The inside of the reaction vessel was purged with dry nitrogen gas, and then 0.1 parts by weight of titanium tetrabutoxide was added thereto, and polymerization reaction was performed under stirring in a nitrogen gas flow at 180° C. for 8 hours. Further, 0.2 parts by weight of titanium tetrabutoxide was added thereto, and the temperature was elevated to 220° C., and polymerization reaction was performed under stirring for 6 hours. Thereafter, the pressure in the reaction vessel was reduced to 10 mmHg, and reaction was performed under reduced pressure to obtain crystalline polyester resin 2. The weight average molecular weight (Mw), melting point (mp), and recrystallization temperature (Rc) of crystalline polyester resin 2 obtained were 22,000, 75.0° C., and 70.8° C., respectively.

(Preparation of Crystalline Polyester Resin Particle Dispersion 2)

Crystalline polyester resin 2 in an amount of 100 parts by weight was dissolved in 400 parts by weight of ethyl acetate (manufactured by KANTO CHEMICAL CO., INC.), and the resultant was mixed with 638 parts by weight of a 0.26 mass % sodium laurylsulfate solution prepared in advance. The mixed solution was subjected to ultrasound dispersion with the ultrasound homogenizer US-150T (manufactured by NISSEI Corporation) at 300 μA of V-LEVEL under stirring for 30 minutes. Thereafter, the resultant was warmed to 40° C., and at the temperature the ethyl acetate was completely removed with the diaphragm vacuum pump V-700 (manufactured by BUCHI Ladotechnik AG) under reduced pressure and stirring for 3 hours to prepare crystalline polyester resin particle dispersion 2. The crystalline polyester resin particle in the dispersion had a volume-based median diameter of 160 nm.

(Synthesis of Crystalline Polyester Resin 3)

In a reaction vessel equipped with a stirring apparatus, a nitrogen introduction tube, a temperature sensor, and a rectifying column, 200 parts by weight of dodecanedioic acid and 102 parts by weight of 1,6-hexanediol were charged, and the temperature of the reaction system was elevated to 190° C. over 1 hour. After confirmation that the reaction system was homogeneously stirred, 0.3 parts by weight of $Ti(OBu)_4$ as a catalyst was charged therein and the temperature of the reaction system was further elevated from 190° C. to 240° C. over 6 hours while water generated was distilled away, and dehydration condensation reaction was continuously performed for 6 hours with the temperature maintained at 240° C. for polymerization to obtain crystalline polyester resin 3. The weight average molecular weight (Mw), melting point (mp), and recrystallization temperature (Rc) of crystalline polyester resin 3 obtained were 14,500, 70° C., and 65.8° C., respectively.

(Preparation of Crystalline Polyester Resin Particle Dispersion 3)

Crystalline polyester resin 3 in an amount of 100 parts by weight was dissolved in 400 parts by weight of ethyl acetate (manufactured by KANTO CHEMICAL CO., INC.), and the resultant was mixed with 638 parts by weight of a 0.26 mass % sodium laurylsulfate solution prepared in advance. The mixed solution was subjected to ultrasound dispersion with the ultrasound homogenizer US-150T (manufactured by NISSEI Corporation) at 300 μA of V-LEVEL under stirring for 30 minutes. Thereafter, the resultant was warmed to 40° C., and at the temperature the ethyl acetate was completely removed with the diaphragm vacuum pump V-700 (manufactured by BUCHI Ladotechnik AG) under reduced pressure and stirring for 3 hours to prepare crystalline polyester resin particle dispersion 3. The crystalline polyester resin particle in the dispersion had a volume-based median diameter of 160 nm.

(Preparation of Coloring Agent Particle Dispersion)

To a solution prepared by adding 90 parts by weight of sodium dodecylsulfate to 1,600 parts by weight of ion-exchanged water, 420 parts by weight of copper phthalocyanine (C. I. Pigment Blue 15:3) was gradually added under stirring. The resultant was dispersed with the stirring apparatus CLEARMIX (manufactured by M Technique Co., Ltd., "CLEARMIX" is a registered trademark possessed by the company) to prepare a coloring agent particle dispersion. The coloring agent particle in the dispersion had a volume-based median diameter of 110 nm.

[Preparation of Amorphous Vinyl Resin Particle Dispersion for Core]

(First Stage of Polymerization)

In a 5 L reaction vessel equipped with a stirring apparatus, a temperature sensor, a condenser, and a nitrogen introduction tube, 8 parts by weight of sodium dodecylsulfate and 3,000 parts by weight of ion-exchanged water were charged, and the internal temperature was elevated to 80° C. under stirring at a stirring rate of 230 rpm in a nitrogen gas flow. After the temperature elevation, a solution prepared by dissolving 10 parts by weight of potassium persulfate in 200 parts by weight of ion-exchanged water was added thereto, and the temperature of the solution was again set to 80° C. and a mixed solution of the following monomers was added dropwise thereto over 1 hour.

| | |
|---|---|
| Styrene | 480.0 parts by weight |
| n-Butyl acrylate | 250.0 parts by weight |
| Methacrylic acid | 68.0 parts by weight |

After the dropwise addition of the mixed solution, the resultant was heated and stirred at 80° C. for 2 hours to polymerize the monomers, and thus an amorphous vinyl resin particle dispersion for a core was prepared.

(Second Stage of Polymerization)

In a 5 L reaction vessel equipped with a stirring apparatus, a temperature sensor, a condenser, and a nitrogen introduction tube, a solution prepared by dissolving 7 parts by weight of sodium polyoxyethylene (2) dodecyl ether sulfate in 3,000 parts by weight of ion-exchanged water was charged, and heated to 98° C. After the heating, the amorphous vinyl resin particle dispersion prepared in the first stage of polymerization in an amount of 80 parts by weight in terms of solid content, and a mixed solution prepared by dissolving the following monomers, chain transfer agent, and release agent at 90° C. were added thereto.

| | |
|---|---|
| Styrene (St) | 285.0 parts by weight |
| n-Butyl acrylate (BA) | 95.0 parts by weight |
| Methacrylic acid (MAA) | 20.0 parts by weight |
| n-Octyl-3-mercaptopropionate (chain transfer agent) | 1.5 parts by weight |
| Behenyl behenate (release agent, melting point: 73° C.) | 190.0 parts by weight |

Mixing and dispersing was carried out with a CLEARMIX (manufactured by M Technique Co., Ltd.), a mechanical disperser having a circulation path, for 1 hour to prepare a dispersion containing an emulsified particle (oil droplet). To this dispersion, a solution of a polymerization initiator prepared by dissolving 6 parts by weight of potassium persulfate in 200 parts by weight of ion-exchanged water was added, and this system was heated and stirred at 84° C. over 1 hour for polymerization to prepare an amorphous vinyl resin particle dispersion.

(Third Stage of Polymerization)

To the amorphous vinyl resin particle dispersion obtained in the second stage of polymerization, 400 parts by weight of ion-exchanged water was further added and thoroughly mixed, and then a solution prepared by dissolving 11 parts by weight of potassium persulfate in 400 parts by weight of ion-exchanged water was added thereto. Furthermore, a mixed solution of the following monomers and chain transfer agent was added dropwise thereto under a temperature condition of 82° C. over 1 hour.

| | |
|---|---|
| Styrene (St) | 454.8 parts by weight |
| 2-Ethylhexyl acrylate (2EHA) | 143.2 parts by weight |
| Methacrylic acid (MAA) | 52.0 parts by weight |
| n-Octyl-3-mercaptopropionate | 8.0 parts by weight |

After the dropwise addition, the resultant was heated and stirred over 2 hours for polymerization, and then cooled to 28° C. to prepare an amorphous vinyl resin dispersion for a core.

[Amorphous Polyester Resin for Shell Layer]

A mixed solution of the following monomers of a styrene-acrylic resin, monomer having a substituent capable of reacting with both of an amorphous polyester resin and the styrene-acrylic resin, and polymerization initiator was placed in a dropping funnel.

| | |
|---|---|
| Styrene | 80.0 parts by weight |
| n-Butyl acrylate | 20.0 parts by weight |
| Acrylic acid | 10.0 parts by weight |
| Di-t-butyl peroxide (polymerization initiator) | 16.0 parts by weight |

The following monomers of an amorphous polyester resin were placed in a four-necked flask equipped with a nitrogen introduction tube, a dehydration tube, a stirrer, and a thermocouple, and heated to 170° C. to dissolve.

| | |
|---|---|
| Propylene oxide-2 mol adduct of bisphenol A | 285.7 parts by weight |
| Terephthalic acid | 66.9 parts by weight |
| Fumaric acid | 47.4 parts by weight |

The mixed solution placed in the dropping funnel was added dropwise into the four-necked flask over 90 minutes under stirring, and the resultant was aged for 60 minutes, and unreacted monomers were then removed under reduced pressure (8 kPa). Thereafter, 0.4 parts by weight of $Ti(OBu)_4$ as an esterification catalyst was charged therein, and the temperature was elevated to 235° C., and reaction was performed under normal pressure (101.3 kPa) for 5 hours and then under reduced pressure (8 kPa) for 1 hour. The resultant was then cooled to 200° C. and allowed to react under reduced pressure (20 kPa) for 1 hour, and subsequently subjected to desolventization to afford an amorphous polyester resin for a shell layer modified with a styrene-acrylic resin. The weight average molecular weight (Mw) and the glass transition temperature (Tg) of the amorphous polyester resin for a shell layer obtained were 25,000 and 60° C., respectively. The weight average molecular weight (Mw) was measured in the same manner as in the case of the above-described crystalline polyester resin, and the glass transition temperature (Tg) was measured in the same manner as in the case of the amorphous vinyl resin.

[Preparation of Amorphous Polyester Resin Particle Dispersion for Shell Layer]

The amorphous polyester resin for a shell layer in an amount of 100 parts by weight was dissolved in 400 parts by weight of ethyl acetate (manufactured by KANTO CHEMICAL CO., INC.), and the resultant was mixed with 638 parts by weight of a 0.26 mass % sodium laurylsulfate solution prepared in advance. The mixed solution was subjected to ultrasound dispersion with the ultrasound homogenizer US-150T (manufactured by NISSEI Corporation) at 300 μA of V-LEVEL under stirring for 30 minutes. Thereafter, the resultant was warmed to 40° C., and at the temperature the ethyl acetate was completely removed with the diaphragm vacuum pump V-700 (manufactured by BUCHI Ladotechnik AG) under reduced pressure and stirring for 3 hours to prepare an amorphous polyester resin particle dispersion for a shell layer having a solid content of 13.5 mass %. The amorphous polyester resin particle in the dispersion had a volume-based median diameter of 160 nm.

Example 1

(Production of Toner 1)

Into a reaction vessel equipped with a stirring apparatus, a temperature sensor, and a condenser, 285 parts by weight (in terms of solid content) of the amorphous vinyl resin particle dispersion for a core, 40 parts by weight (in terms of solid content) of crystalline polyester resin particle dispersion 1, sodium dodecyldiphenyl ether disulfonate at a resin ratio of 1 mass % (in terms of solid content), and 2,000 parts by weight of ion-exchanged water were charged. At room temperature (25° C.), a 5 mol/L aqueous solution of sodium hydroxide was added thereto to adjust the pH to 10. Further, 30 parts by weight (in terms of solid content) of the coloring agent particle dispersion was charged therein, and a solution prepared by dissolving 60 parts by weight of magnesium chloride in 60 parts by weight of ion-exchanged water was added thereto under stirring at 30° C. over 10 minutes. After the resultant was left to stand for 3 minutes, the temperature was elevated to 80° C. over 60 minutes. After the temperature reached 80° C., the stirring rate was adjusted so that the growth rate of the particle size became 0.01 μm/min, and the particle was allowed to grow until the volume-based median diameter measured with a Coulter Multisizer 3 (manufactured by Beckman Coulter, Inc.) reached 6.0 μm.

Subsequently, 37 parts by weight (in terms of solid content) of the amorphous polyester resin particle dispersion for a shell was charged therein over 30 minutes, and at the timing when the supernatant of the dispersion became clear, an aqueous solution prepared by dissolving 190 parts by weight of sodium chloride in 760 parts by weight of ion-exchanged water was added thereto to terminate the growth of the particle. The temperature was then elevated to 80° C. and at the temperature stirring was performed to allow the fusion of the particle to progress until the average circularity of the toner base particle reached 0.970. Then, the dispersion of the toner base particle obtained was subjected to the following cooling/heat treatment steps: 1) the temperature of the dispersion was lowered to 65° C. (pre-heat treatment step temperature) with the temperature-lowering rate (cooling rate) at Rc adjusted to 1.0° C./min; 2) the dispersion was then cooled from 65° C. (initiation temperature) to 46° C. (termination temperature) over 30 minutes (scheme 1 in Table 1), and thereafter the dispersion was cooled to 30° C.

Subsequently, solid-liquid separation was performed, and the toner cake dehydrated was redispersed in ion-exchanged water, and washed through three cycles of solid-liquid separation. After washing, the resultant was dried at 40° C. for 24 hours to afford a toner particle. To 100 parts by weight of the toner particle obtained, 0.6 parts by weight of a hydrophobic silica particle (number average primary particle size: 12 nm, degree of hydrophobicity: 68), 1.0 part by weight of a hydrophobic titanium oxide particle (number average primary particle size: 20 nm, degree of hydrophobicity: 63), and 1.0 part by weight of sol-gel silica (number average primary particle size=110 nm) were added, and the resultant was mixed by using a Henschel mixer (manufactured by NIPPON COKE & ENGINEERING Co., LTD.) with a blade rotation speed of 35 mm/sec at 32° C. for 20 minutes. After mixing, coarse particles were removed with a sieve having a mesh size of 45 μm to obtain toner 1.

Examples 2 to 6

Toners 2 to 6 were produced in the same manner as in Example 1 except that the cooling/heat treatment steps were changed to Schemes 2 to 6, respectively, listed in Table 1.

Example 7

Toner 7 was produced in the same manner as in Example 1 except that the cooling/heat treatment steps were changed to scheme 6 listed in Table 1 and the cooling rate at Rc was changed to 2° C./min.

Example 8

Toner 8 was produced in the same manner as in Example 1 except that the cooling/heat treatment steps were changed to scheme 6 listed in Table 1 and the cooling rate at Rc was changed to 5° C./min.

Example 9

Toner 9 was produced in the same manner as in Example 1 except that the cooling/heat treatment steps were changed to scheme 7 listed in Table 1 and the cooling rate at Rc was changed to 2° C./min.

Example 10

Toner 10 was produced in the same manner as in Example 1 except that the cooling/heat treatment steps were changed to scheme 8 listed in Table 1 and the cooling rate at Rc was changed to 2° C./min.

Example 11

Toner 11 was produced in the same manner as in Example 1 except that the cooling/heat treatment steps were changed to scheme 9 listed in Table 1 and the cooling rate at Rc was changed to 2° C./min.

Example 12

Toner 12 was produced in the same manner as in Example 1 except that crystalline polyester resin particle dispersion 1 was replaced with crystalline polyester resin particle dispersion 2, the cooling/heat treatment steps were changed to scheme 6 listed in Table 1, and the cooling rate at Rc was changed to 2° C./min.

Example 13

Toner 13 was produced in the same manner as in Example 1 except that crystalline polyester resin particle dispersion 1 was replaced with crystalline polyester resin particle dispersion 2, the cooling/heat treatment steps were changed to scheme 10 listed in Table 1, and the cooling rate at Rc was changed to 2° C./min.

Example 14

Toner 14 was produced in the same manner as in Example 1 except that crystalline polyester resin particle dispersion 1 was replaced with crystalline polyester resin particle dispersion 3, the cooling/heat treatment steps were changed to scheme 11 listed in Table 1, and the cooling rate at Rc was changed to 2° C./min.

Example 15

Toner 15 was produced in the same manner as in Example 1 except that crystalline polyester resin particle dispersion 1 was replaced with crystalline polyester resin particle dispersion 3, the cooling/heat treatment steps were changed to scheme 12 listed in Table 1, and the cooling rate at Rc was changed to 2° C./min.

Comparative Example 1

Toner 16 was produced in the same manner as in Example 1 except that the cooling/heat treatment steps were changed to scheme 6 listed in Table 1 and the cooling rate at Rc was changed to 0.5° C./min.

Comparative Example 2

Toner 17 was produced in the same manner as in Example 1 except that the cooling/heat treatment steps were changed to scheme 13 listed in Table 1 and the cooling rate at Rc was changed to 2° C./min.

Comparative Example 3

Toner 18 was produced in the same manner as in Example 1 except that the cooling/heat treatment steps were changed to scheme 14 listed in Table 1 and the cooling rate at Rc was changed to 2° C./min.

Comparative Example 4

(Production of Toner 19)

In the process for producing toner 1, a dispersion of a toner base particle was cooled without being subjected to a heat treatment step. Solid-liquid separation was then performed, and the toner cake dehydrated was redispersed in ion-exchanged water, and washed through three cycles of solid-liquid separation, and dried at 40° C. for 24 hours. The toner base particle obtained was left to stand in an environment of 60° C. and 50% RH for 60 minutes. To 100 parts by weight of the toner base particle obtained, 0.6 parts by weight of a hydrophobic silica particle (number average primary particle size: 12 nm, degree of hydrophobicity: 68), 1.0 part by weight of a hydrophobic titanium oxide particle (number average primary particle size: 20 nm, degree of hydrophobicity: 63), and 1.0 part by weight of sol-gel silica (number average primary particle size=110 nm) were added, and the resultant was mixed by using a Henschel mixer (manufactured by NIPPON COKE & ENGINEERING Co., LTD.) with a blade rotation speed of 35 mm/sec at 32° C. for 20 minutes. After mixing, coarse particles were removed with a sieve having a mesh size of 45 μm to obtain toner 19.

Comparative Example 5

(Production of Toner 20)

The following raw materials were mixed together, and a 15 mm ceramic bead was charged into the mixed solution obtained, and the resultant was dispersed with an attritor (manufactured by Mitsui Miike Chemical Engineering Machinery, Co., Ltd.) for 2 hours to obtain a polymerizable monomer composition.

| | |
|---|---|
| Styrene (St) | 50.0 parts by weight |
| n-Butyl acrylate (BA) | 16.7 parts by weight |
| Methacrylic acid (MAA) | 3.5 parts by weight |
| Behenyl behenate (release agent, melting point: 73° C.) | 7.0 parts by weight |
| Crystalline polyester resin 1 | 8.0 parts |

Subsequently, 800 parts of ion-exchanged water and 15.5 parts of tricalcium phosphate were added into a container equipped with the high-speed stirring apparatus TK-homomixer (manufactured by Tokushu Kika Kogyo Co., Ltd.), and the rotational frequency was adjusted to 15,000 $min^{-1}$ and the temperature was elevated to 70° C. to obtain an aqueous dispersion medium. To the above polymerizable monomer composition, 4.0 parts of t-butyl peroxypivalate as a polymerization initiator was added, and the resultant was charged into the aqueous dispersion medium. Dispersing was performed for granulation by using the high-speed stirring apparatus for 3 minutes, with the rotational frequency maintained at 15,000 $min^{-1}$. Thereafter, the high-speed stirring apparatus was replaced with a stirring apparatus having a propeller stirring blade, and polymerization was performed under stirring at 150 $min^{-1}$ for 8.0 hours with the temperature retained at 70° C., and the temperature was elevated to 80° C. and heating was performed for 4 hours. Cooling/heat treatment was then performed by using the scheme for toner 7.

Subsequently, solid-liquid separation was performed, and the toner cake dehydrated was redispersed in ion-exchanged water, and washed through three cycles of solid-liquid separation. After washing, the resultant was dried at 40° C. for 24 hours to afford a toner particle. To 100 parts by weight of the toner particle obtained, 0.6 parts by weight of a hydrophobic silica particle (number average primary particle size: 12 nm, degree of hydrophobicity: 68), 1.0 part by weight of a hydrophobic titanium oxide particle (number average primary particle size: 20 nm, degree of hydrophobicity: 63), and 1.0 part by weight of sol-gel silica (number average primary particle size=110 nm) were added, and the resultant was mixed by using a Henschel mixer (manufactured by NIPPON COKE & ENGINEERING Co., LTD.) with a blade rotation speed of 35 mm/sec at 32° C. for 20 minutes. After mixing, coarse particles were removed with a sieve having a mesh size of 45 μm to obtain toner 20.

In Table 1, "T0", "T1", and "T2" denote "pre-heat treatment step temperature", "initiation temperature" of a heat treatment step, and "termination temperature" of a heat treatment step, respectively.

TABLE 1

| | | Heat treatment step | | | |
|---|---|---|---|---|---|
| Scheme (No.) | T0 (° C.) | T1 (° C.) | T2 (° C.) | Scheme | Duration (min) |
| 1 | 65 | 65 | 46 | cooling | 30 |
| 2 | 65 | 65 | 46 | cooling | 60 |
| 3 | 65 | 65 | 65 | retention | 60 |
| 4 | 60 | 60 | 60 | retention | 60 |
| 5 | 45 | 60 | 60 | retention | 60 |
| 6 | 30 | 60 | 60 | retention | 60 |
| 7 | 30 | 55 | 55 | retention | 60 |
| 8 | 30 | 50 | 50 | retention | 60 |
| 9 | 30 | 45 | 45 | retention | 60 |
| 10 | 30 | 60 | 60 | retention | 120 |
| 11 | 30 | 55 | 55 | retention | 60 |
| 12 | 30 | 41 | 41 | retention | 60 |
| 13 | 30 | 70 | 70 | retention | 60 |
| 14 | 30 | 67 | 67 | retention | 60 |

[Evaluation for Toners]

(Evaluation on Low-Temperature Fixability (Under-Offset)]

An under-offset is an image defect in which a toner peels off from a toner receiving article such as a recording sheet because melting of a toner layer by heat provided in passing through a fixing apparatus is insufficient. For evaluation on low-temperature fixability, each toner produced in the above was sequentially loaded on an image forming apparatus and an unfixed solid image (amount of attachment: 11.3 $g/m^2$) was formed on an NPI of 128 $g/m^2$ (manufactured by Nippon Paper Industries Co., Ltd.) with the image forming apparatus in an environment of normal temperature and normal humidity (20° C., 50% RH). Subsequently, the surface temperature of a pressure roller of the fixing apparatus was set to 100° C. and fixing was performed with the surface temperature of a heating roller changed at an interval of 2° C. within the range of 130 to 170° C. Then, the lower limit temperature for fixing with no under-offset was measured for the upper fixing belt. Measurement of the lower limit temperature for fixing was performed for each of toners 1 to 20, and evaluation on low-temperature fixability was performed by using the following evaluation criteria, and a lower limit temperature for fixing of 155° C. or lower was regarded as being acceptable. The results are shown in Table 2.

(Evaluation on Toner Splashing Characteristics)

The developer prepared in the above was loaded on a "bizhub PRESS C1070" (manufactured by Konica Minolta, Inc., "bizhub" is a registered trademark possessed by the company), a commercially available multifunctional peripheral, as an evaluation apparatus for toner splashing characteristics. In a printing environment of 20° C. and 55% RH, a character image having a coverage rate of 5% was printed on 10,000 sheets of A4 wood-free paper, and a character image having a coverage rate of 10% was then printed on 10,000 sheets of A4 wood-free paper, and further a character image having a coverage rate of 20% was printed on 10,000 sheets of A4 wood-free paper, i.e., 30,000 sheets were printed in total. The amount of toner splashing is the amount of a toner splashed on the main body of an image forming apparatus, a cartridge, and a toner filter after printing on 30,000 sheets. The toner splashed on a periphery portion of the developing section such as the upper cap of the cartridge was suctioned after printing on 30,000 sheets to measure the weight, and the weight of the toner attached on the toner filter was measured, and the sum of the weights was used as the amount of toner splashing (g). An amount of toner splashing of 4.0 g or less was regarded as being acceptable. The results are shown in Table 2.

In Table 2, "EA" denotes "emulsion aggregation method"; "SP" denotes "suspension polymerization method"; "mp" denotes "melting point"; "Ts1" denotes "temperature of dispersion in step 1"; "R1" denotes "cooling rate at Rc"; "Med" denotes "medium in heat treatment"; "aqueous" refers to "aqueous medium"; "Scheme (No.)" indicates "type of cooling/heat treatment scheme"; "Tf" denotes "fixing temperature"; and "Ats" denotes "amount of toner splashing".

It can be seen from Table 2 that the toners in Examples 1 to 15, which contained a toner based particle produced through cooling/heat treatment including a step of cooling a dispersion containing an aqueous medium and particles of the crystalline polyester resin as the binder resin and having been heated to a temperature higher than the recrystallization temperature Rc of a crystalline resin to a temperature lower than Rc at a temperature-lowering rate of 1° C./min or higher, and a next step of maintaining the resultant dispersion in a temperature region of higher than or equal to Rc−25° C. and lower than or equal to the Rc−5° C. for 30 minutes or longer, each had sufficient low-temperature fixability and satisfactory toner splashing characteristics.

The reason for improvement in low-temperature fixability and toner splashing characteristics is not clear. However, it is inferred that the crystalline resin which had been once heated to a temperature higher than or equal to the melting point to melt was recrystallized at a moderate rate and thus the domain diameter of the crystalline resin did not increase too much and the crystalline resin was finely dispersed in the toner, without being localized in the vicinity of the surface of the toner, and the softened state of the amorphous resin was kept, and as a result the low-temperature fixability was retained.

Further, it is inferred that heat treatment in an aqueous medium prevented the change of the adsorption state of water molecules in the toner, which prevented the elevation of the glass transition temperature of the binder resin and as a result the low-temperature fixability was retained. Furthermore, it is inferred that the crystalline resin was not exposed in the surface of the toner, and for this reason, lowering of the surface resistance of the toner and deterioration of the charging characteristics of the toner were not caused and as a result the toner splashing characteristics were improved. It can be seen that toner splashing characteristics were especially improved in Examples 7 to 15, in which the cooling rate at Rc was set to 2° C./min or higher.

In contrast, the low-temperature fixability and the toner splashing characteristics were both insufficient in Comparative Example 1. This is presumably because the too low cooling rate at Rc of lower than 1° C./min promoted the recrystallization of the crystalline resin to increase the

TABLE 2

| | | | Crystalline resin | | | | | | | | |
|---|---|---|---|---|---|---|---|---|---|---|---|
| | Toner (No.) | Production process | Type (No.) | mp (° C.) | Rc (° C.) | Ts1 (° C.) | R1 (° C./min) | Med | Scheme (No.) | Tf (° C.) | Ats (g) |
| Example 1 | 1 | EA | 1 | 75.5 | 70.6 | 80 | 1 | aqueous | 1 | 154 | 3.0 |
| Example 2 | 2 | EA | 1 | 75.5 | 70.6 | 80 | 1 | aqueous | 2 | 154 | 2.5 |
| Example 3 | 3 | EA | 1 | 75.5 | 70.6 | 80 | 1 | aqueous | 3 | 154 | 2.4 |
| Example 4 | 4 | EA | 1 | 75.5 | 70.6 | 80 | 1 | aqueous | 4 | 152 | 2.0 |
| Example 5 | 5 | EA | 1 | 75.5 | 70.6 | 80 | 1 | aqueous | 5 | 152 | 1.8 |
| Example 6 | 6 | EA | 1 | 75.5 | 70.6 | 80 | 1 | aqueous | 6 | 152 | 1.2 |
| Example 7 | 7 | EA | 1 | 75.5 | 70.6 | 80 | 2 | aqueous | 6 | 148 | 0.7 |
| Example 8 | 8 | EA | 1 | 75.5 | 70.6 | 80 | 5 | aqueous | 6 | 144 | 0.6 |
| Example 9 | 9 | EA | 1 | 75.5 | 70.6 | 80 | 2 | aqueous | 7 | 146 | 0.7 |
| Example 10 | 10 | EA | 1 | 75.5 | 70.6 | 80 | 2 | aqueous | 8 | 146 | 0.7 |
| Example 11 | 11 | EA | 1 | 75.5 | 70.6 | 80 | 2 | aqueous | 9 | 146 | 0.8 |
| Example 12 | 12 | EA | 2 | 75.0 | 70.8 | 80 | 2 | aqueous | 6 | 150 | 0.9 |
| Example 13 | 13 | EA | 2 | 75.0 | 70.8 | 80 | 2 | aqueous | 10 | 150 | 0.8 |
| Example 14 | 14 | EA | 3 | 70.0 | 65.8 | 80 | 2 | aqueous | 11 | 144 | 1.0 |
| Example 15 | 15 | EA | 3 | 70.0 | 65.8 | 80 | 2 | aqueous | 12 | 144 | 1.2 |
| Comparative Example 1 | 16 | EA | 1 | 75.5 | 70.6 | 80 | 0.5 | aqueous | 6 | 156 | 5.8 |
| Comparative Example 2 | 17 | EA | 1 | 75.5 | 70.6 | 80 | 2 | aqueous | 13 | 160 | 5.0 |
| Comparative Example 3 | 18 | EA | 1 | 75.5 | 70.6 | 80 | 2 | aqueous | 14 | 158 | 4.5 |
| Comparative Example 4 | 19 | EA | 1 | 75.5 | 70.6 | 80 | 2 | — | — | 162 | 5.4 |
| Comparative Example 5 | 20 | SP | 1 | 75.5 | 70.6 | 80 | 2 | aqueous | 6 | 154 | 5.4 |

domain diameter of the crystalline resin and the bleed out of the crystalline resin occurred in the surface of the toner. Similarly, the low-temperature fixability and the toner splashing characteristics were insufficient in each of Comparative Examples 2 and 3. This is presumably because heat treatment performed in a high temperature region of higher than Rc−5° C. increased the domain diameter of the crystalline resin and the bleed out of the crystalline resin occurred in the surface of the toner, as with Comparative Example 1.

In Comparative Example 4, the low-temperature fixability and the toner splashing characteristics were both poor. This is presumably because heat treatment was not performed and thus the state of being of the crystalline resin in the toner was not controlled and the crystalline resin was localized on the surface of the toner base particle.

In Comparative Example 5, although the low-temperature fixability was not poor, the toner splashing characteristics were poor. This is presumably because the toner base particle was produced by using not an emulsion polymerization aggregation method but a suspension polymerization method and thus the state of being of the crystalline resin in the toner could not be controlled in heat treatment.

INDUSTRIAL APPLICABILITY

The present invention not only provides low-temperature fixability for a toner, but also enables prevention of toner splashing. In addition, the present invention is expected to achieve enhancement of the versatility of a toner in addition to further higher performance, higher speed, and saving of energy in the electrophotographic image forming technology, and the image forming technology will further prevail.

What is claimed is:

1. A process for producing a toner comprising:

a first step of heating a dispersion containing an aqueous medium and a binder resin containing a crystalline resin to a temperature higher than or equal to a melting point of the crystalline resin in a step of aggregating and fusing a fine particle of the binder resin containing the crystalline resin to produce a toner base particle;

a second step of cooling the dispersion having been heated in the first step and having a temperature higher than a recrystallization temperature Rc of the crystalline resin to a temperature lower than the Rc at a temperature-lowering rate of 1° C./min or higher; and a third step of maintaining the dispersion having been cooled in the second step at a temperature higher than or equal to the Rc−25° C. and lower than or equal to the Rc−5° C. for 30 minutes or longer.

2. The process for producing a toner according to claim 1, wherein, in the third step, the temperature of the dispersion is maintained at a temperature higher than or equal to the Rc−25° C. and lower than or equal to the Rc−10° C. for 30 minutes or longer.

3. The process for producing a toner according to claim 1, wherein, in the second step, the dispersion is cooled to a temperature lower than the Rc−25° C.

4. The process for producing a toner according to claim 1, wherein, in the second step, a cooling rate for the dispersion is 2° C./min or higher.

5. The process for producing a toner according to claim 1, wherein the crystalline resin is a crystalline polyester resin.

* * * * *